US010675876B2

(12) United States Patent
Kuno

(10) Patent No.: US 10,675,876 B2
(45) Date of Patent: Jun. 9, 2020

(54) LIQUID STORAGE DEVICE

(71) Applicant: BROTHER KOGYO KABUSHIKI KAISHA, Nagoya-shi, Aichi-ken (JP)

(72) Inventor: Daisuke Kuno, Kariya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 9 days.

(21) Appl. No.: 16/232,704

(22) Filed: Dec. 26, 2018

(65) Prior Publication Data

US 2019/0193409 A1 Jun. 27, 2019

(30) Foreign Application Priority Data

Dec. 27, 2017 (JP) ..... 2017-252027

(51) Int. Cl.

| | |
|---|---|
| ***B41J 2/175*** | (2006.01) |
| ***B41J 29/38*** | (2006.01) |
| ***B41J 29/02*** | (2006.01) |

(52) U.S. Cl.

CPC ..... *B41J 2/17513* (2013.01); *B41J 2/175* (2013.01); *B41J 2/17523* (2013.01); *B41J 2/17563* (2013.01); *B41J 2/17566* (2013.01); *B41J 29/02* (2013.01); *B41J 29/38* (2013.01); *B41J 2002/17569* (2013.01); *B41J 2002/17573* (2013.01); *B41J 2002/17579* (2013.01)

(58) Field of Classification Search

CPC ..... B41J 2/16523; B41J 2/16505; B41J 2/16508; B41J 2/1652; B41J 2/16532; B41J 2/16535; B41J 2/16552; B41J 2/1707; B41J 2/175; B41J 2/17509; B41J 2/17566; B41J 2/17596; B41J 2/18; B41J 29/02; B41J 29/38; B41J 2202/16594; B41J 2202/12

See application file for complete search history.

(56) References Cited

U.S. PATENT DOCUMENTS 8,270,880 B2 * 9/2012 Kato ..... G03G 15/105 399/120

2009/0189931 A1 7/2009 Noro et al.

FOREIGN PATENT DOCUMENTS

| | | | |
|---|---|---|---|
| JP | 2006-001171 | A | 1/2006 |
| JP | 2009-202565 | A | 9/2009 |
| JP | 2014-166741 | A | 9/2014 |

OTHER PUBLICATIONS

New U.S. Patent Application claiming priority to JP Patent Application No. 2017-252023 filed on Dec. 27, 2017. (Client/Brother Ret Nos. 17289BRK21/2017-00281US00).

* cited by examiner

*Primary Examiner* — Thinh H Nguyen

(74) *Attorney, Agent, or Firm* — K&L Gates LLP

(57) ABSTRACT

A liquid storage device includes a tank, a shaft, an agitator blade, and a sealing member. The tank is configured to store ink to be supplied to an inkjet head. The shaft is configured to be inserted inside the tank via an insertion hole provided in the tank. The agitator blade is disposed inside the tank and is connected to the shaft. The sealing member is configured to block a space between the shaft and the insertion hole for a period during which the agitator blade is not rotating and is configured to open the space between the shaft and the insertion hole for at least a part of a period during which the agitator blade is rotating.

9 Claims, 10 Drawing Sheets

LIQUID STORAGE DEVICE

CROSS-REFERENCE TO RELATED APPLICATION

This application claims priority to Japanese Patent Application No. 2017-252027 filed on Dec. 27, 2017, the disclosure of which is herein incorporated by reference in its entirety.

BACKGROUND

The present disclosure relates to a liquid storage device.

A liquid storage device is known that is provided in an inkjet printer. The liquid storage device is provided with an ink storage portion that stores ink, and a propeller member that is attached to a shaft that pierces a lid of the ink storage portion. The propeller member rotates in concert with a rotation of the shaft and agitates the ink.

SUMMARY

In the above-described liquid storage device, in order to prevent drying out of the ink, a sealing member that seals a space between an insertion hole provided in the lid of the ink storage portion and the shaft is conceivable.

However, if the space between the insertion hole and the shaft is sealed using the sealing member, the sealing member becomes worn by the rotation of the shaft when the shaft rotates, and there is a possibility that a part of the sealing member may enter inside a tank.

Various embodiments of the general principles described herein provide a liquid storage device that reduces a possibility of a part of a sealing member, which blocks a space between a shaft and an insertion hole, from entering the interior of a tank, when ink or a recording material is agitated.

Embodiments herein provide a liquid storage device that includes a tank, a shaft, an agitator blade, and a sealing member. The tank is configured to store ink to be supplied to an inkjet head. The shaft is configured to be inserted inside the tank via an insertion hole provided in the tank. The agitator blade is disposed inside the tank and is connected to the shaft. The sealing member is configured to block a space between the shaft and the insertion hole for a period during which the agitator blade is not rotating and configured to open the space between the shaft and the insertion hole for at least a part of a period during which the agitator blade is rotating.

Embodiments herein also provide a liquid storage device that includes a tank, a shaft, an agitator blade, and a sealing member. The tank is configured to store a recording material to be ejected onto a recording medium. The shaft is configured to be inserted inside the tank via an insertion hole provided in the tank. The agitator blade is disposed inside the tank and is connected to the shaft. Thea sealing member is configured to block a space between the shaft and the insertion hole for a period during which the agitator blade is not rotating and configured to open the space between the shaft and the insertion hole for at least a part of a period during which the agitator blade is rotating.

BRIEF DESCRIPTION OF THE DRAWINGS

Embodiments will be described below in detail with reference to the accompanying drawings in which.

DETAILED DESCRIPTION

First Embodiment

Hereinafter, as an example of the liquid storage device of the present disclosure, a print device 1 will be explained with reference to the drawings. An overview of the print device 1 will be explained with reference to FIG. 1. The upward direction, the downward direction, the left downward direction, the right upward direction, the right downward direction and the left upward direction in FIG. 1 respectively correspond to an upward direction, a downward direction, a front direction, a rear direction, a right direction and a left direction of the print device 1.

Figure 2:
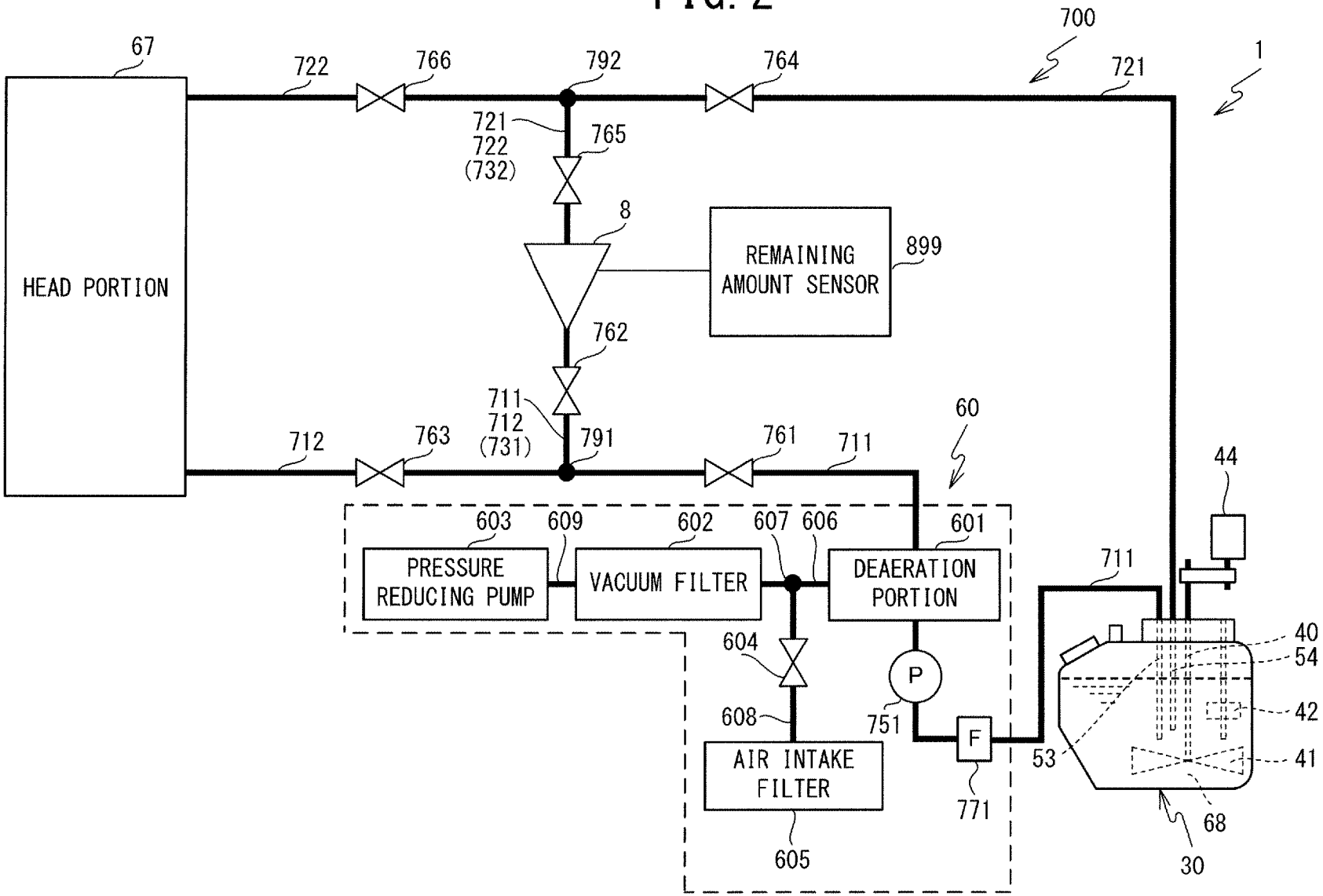
FIG. 2 is a diagram schematically showing a configuration of the print device.

The print device 1 is an inkjet printer that performs printing on a fabric such as a T-shirt, or a recording medium such as paper, by ejecting an ink 68 (refer to FIG. 2) from nozzles of a head portion 67 (refer to FIG. 2). The print device 1 prints a color image on the recording medium by downwardly ejecting, for example, five different types (white (W), black (K), yellow (Y), cyan (C) and magenta (M)) of the ink 68. In the following explanation, of the five types of the ink 68, the white ink 68 is referred to as white ink. The four colors of the ink 68, i.e., the black, cyan, yellow and magenta inks, are collectively referred to as color inks. The white ink is an ink having higher settleability than the color inks.

Figure 1:
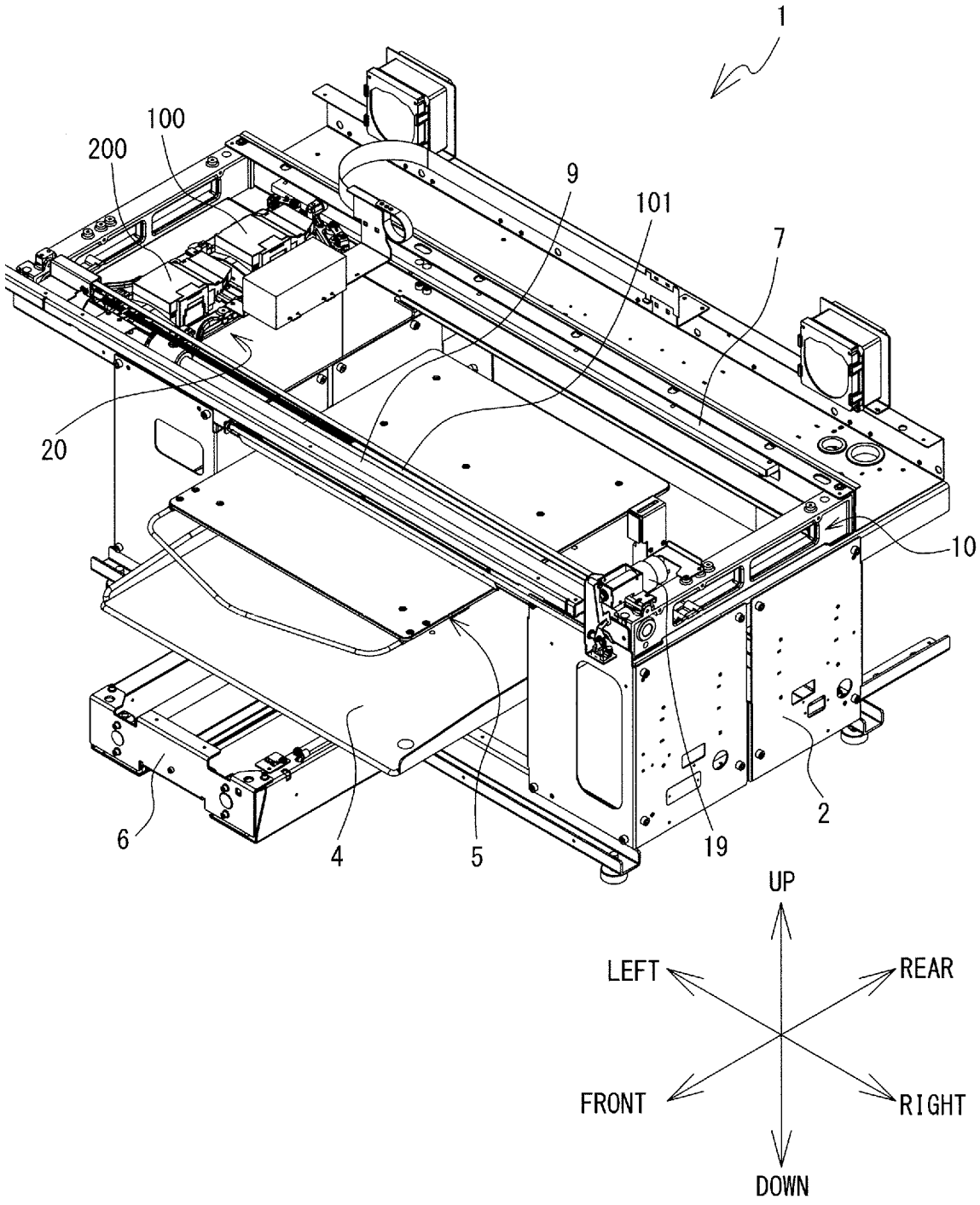
FIG. 1 is a perspective view of a print device.

As shown in FIG. 1, the print device 1 is provided with a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101, and a drive motor 19. An operating button 501 (refer to FIG. 6) that is used to perform operations of the print device 1 is provided at a front position on the right side of the housing 2. The operating button 501 is operated when an operator inputs commands relating to various operations of the print device 1.

The frame body 10 has a substantially rectangular frame shape in a plan view, and is installed on an upper portion of the housing 2. The front side of the frame body 10 supports the guide shaft 9, and the rear side of the frame body 10 supports the rail 7. The guide shaft 9 extends in the left-right direction on the inside of the frame body 10. The rail 7 is disposed facing the guide shaft 9 and extends in the left-right direction.

The carriage 20 is supported such that the carriage 20 can be conveyed in the left-right direction along the guide shaft 9. The head units 100 and 200 are mounted on the carriage 20 such that the head units 100 and 200 are aligned in the front-rear direction. The head unit 100 is positioned further to the rear than the head unit 200. The head portion 67 (refer to FIG. 2) is provided on a lower portion of each of the head units 100 and 200. The head portion 67 of the head unit 100 ejects the white ink. The head portion 67 of the head unit 200 ejects the color inks. The head portion 67 is provided with a surface having a plurality of fine nozzles (not shown in the drawings) that can eject the ink 68 downward.

As shown in FIG. 1, the drive belt 101 is stretched along the left-right direction on the inside of the frame body 10. The drive motor 19 is coupled to the carriage 20 via the drive belt 101. When the drive motor 19 drives the drive belt 101, the carriage 20 is caused to reciprocate in the left-right direction along the guide shaft 9.

The platen drive mechanism 6 is provided with the pair of guide rails (not shown in the drawings) and a platen support base (not shown in the drawings). The pair of guide rails extend in the front-rear direction on the inside of the platen drive mechanism 6, and support the platen support base such that the platen support base can move in the front-rear direction. An upper portion of the platen support base supports the platen 5. The platen 5 supports the recording medium. The tray 4 is provided below the platen 5. When the operator places a T-shirt or the like on the platen 5, the tray 4 receives a sleeve or the like of the T-shirt, and thus protects the sleeve or the like such that the sleeve or the like does not come into contact with other components provided inside the housing 2. The platen drive mechanism 6 is driven by a sub-scanning drive portion (not shown in the drawings), and moves the platen support base and the platen 5 along the pair of guide rails in the front-rear direction. Printing by the print device 1 on the recording medium is performed by the platen 5 conveying the recording medium in the front-rear direction (a sub-scanning direction) and the ink 68 being ejected from the head portion 67 that is reciprocating in the left-right direction (a main scanning direction).

As shown in FIG. 2, the print device 1 is provided with an ink supply portion 700. The ink supply portion 700 supplies the white ink 68 to the head portion 67 of the head unit 100. The head portion 67 is provided with an inkjet head. An ink supply portion (not shown in the drawings) that supplies each of the four color inks 68 to the head portion 67 of the head unit 200 may also have a configuration similar to that shown in FIG. 2. Below, the print device 1 will be explained using a configuration relating to the white ink 68.

As shown in FIG. 2, the print device 1 is provided with a main tank 30, a shaft 40, an agitator blade 41, a first tube 53, a second tube 54, a remaining amount sensor 42, an agitator motor 44, and an opening/closing motor 46. The main tank 30 stores the ink 68. The ink 68 stored in the main tank 30 is supplied to the ink supply portion 700, and the ink 68 returning from the ink supply portion 700 is stored once more in the main tank 30. An amount that can be stored in the main tank 30 is greater than an amount that can be stored in a sub pouch 8 to be described later. The agitator motor 44 rotates the shaft 40. The ink 68 is agitated by the agitator blade 41 rotating due to the rotation of the shaft 40. The first tube 53 is connected to a first supply flow path 711 to be described later, and supplies the ink 68 in the main tank 30 to the head portion 67. The second tube 54 is connected to a first circulation flow path 721 to be described later, and returns the ink 68 to the main tank 30. The remaining amount sensor 42 detects a remaining amount of the ink 68 in the main tank 30. The opening/closing motor 46 moves the shaft 40 up and down in the extending direction of the shaft 40.

[Main Tank 30]

Figure 3:
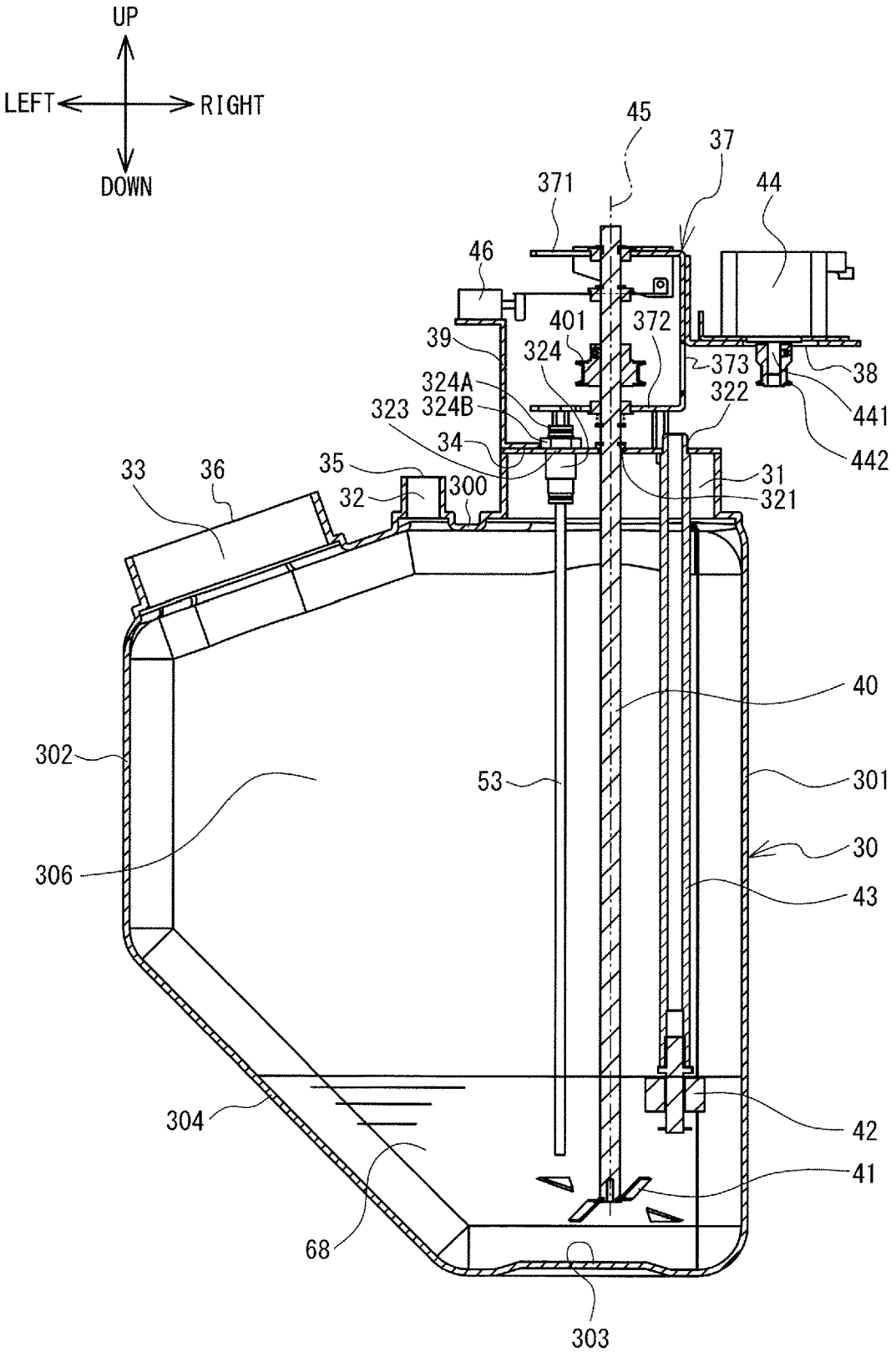
FIG. 3 is a vertical cross-section of a main tank.

As shown in FIG. 3, the main tank 30 is provide with an upper portion 300, a bottom portion 303, a right side surface 301, a left side surface 302, and an inclined surface 304. The left side surface 302 is shorter than the right side surface 301, and a position of the lower end portion of the left side surface 302 is higher than a position of the lower end portion of the right side surface 301. The inclined surface 304 connects the lower end portion of the left side surface 302 and the left end portion of the bottom portion 303. Further, the main tank 30 is provided with a front surface (not shown in the drawings) and a rear surface 306. As shown in FIG. 3, a container opening portion 31, a container opening portion 32, and a container opening portion 33, which are openings, are provided in the upper portion 300. The container opening portion 31, the container opening portion 32, and the container opening portion 33 are respectively closed by a lid 34, a lid 35, and a lid 36. When filling the main tank 30 with the ink 68, the lid 36 is removed, and the ink 68 is supplied into the main tank 30 from the container opening portion 33.

An insertion hole 321, an insertion hole 322, and an insertion hole 323 are provided in the lid 34. The shaft 40 is inserted into the interior of the main tank 30 via the insertion hole 321. A support shaft 43 that supports the remaining amount sensor 42 is fixed to the insertion hole 322. A partition wall fixing member 324 is provided in the insertion hole 323. The partition wall fixing member 324 is internally provided with an through hole (not shown in the drawings), and a screw portion 324A is formed in an upper portion of the partition wall fixing member 324. The partition wall fixing member 324 is fixed to the insertion hole 323 of the lid 34 by the screw portion 324A and a nut 324B. The first tube 53 and the second tube 54 are fixed to the through hole on the internal side in the partition wall fixing member 324, and are inserted inside the main tank 30.

[Opening/Closing Mechanism]

Below, an opening/closing mechanism between the shaft 40 and the insertion hole 321 will be explained. The print device 1 includes the opening/closing mechanism that opens and closes a space between the shaft 40 and the insertion hole 321. For example, the opening/closing mechanism blocks the space between the shaft 40 and the insertion hole 321 for a period during which the agitator blade 41 is not rotating, using a sealing member, such as a sealing member 80 to be described later, and opens the space between the shaft 40 and the insertion hole 321 for at least a part of a period during which the agitator blade 41 rotates. The opening/closing mechanism, for example, may be provided with a configuration that moves the sealing member up and down without moving the shaft 40 up and down, or may be provided with a configuration in which the shaft 40 to which the sealing member is fixed is moved up and down. For example, the sealing member or the shaft 40 may be moved up and down by a drive portion of an actuator, a motor or the like. The opening/closing mechanism is provided with a mechanical transmission mechanism, such as a link, a cam, and the like. The mechanical transmission mechanism is coupled to the sealing member or the shaft 40, and converts a driving force of the drive portion into the up and down movement of the sealing member or the shaft 40.

An example of the opening/closing mechanism between the shaft 40 and the insertion hole 321 will be explained below. As shown in FIG. 3, the shaft 40 is a cylindrically shaped rotating shaft that extends in the up-down direction, and rotates around an axis line 45. The agitator blade 41 is connected to the lower end portion of the shaft 40. Thus, the agitator blade 41 is provided on the side of the bottom portion 303 inside the main tank 30.

Figure 4:
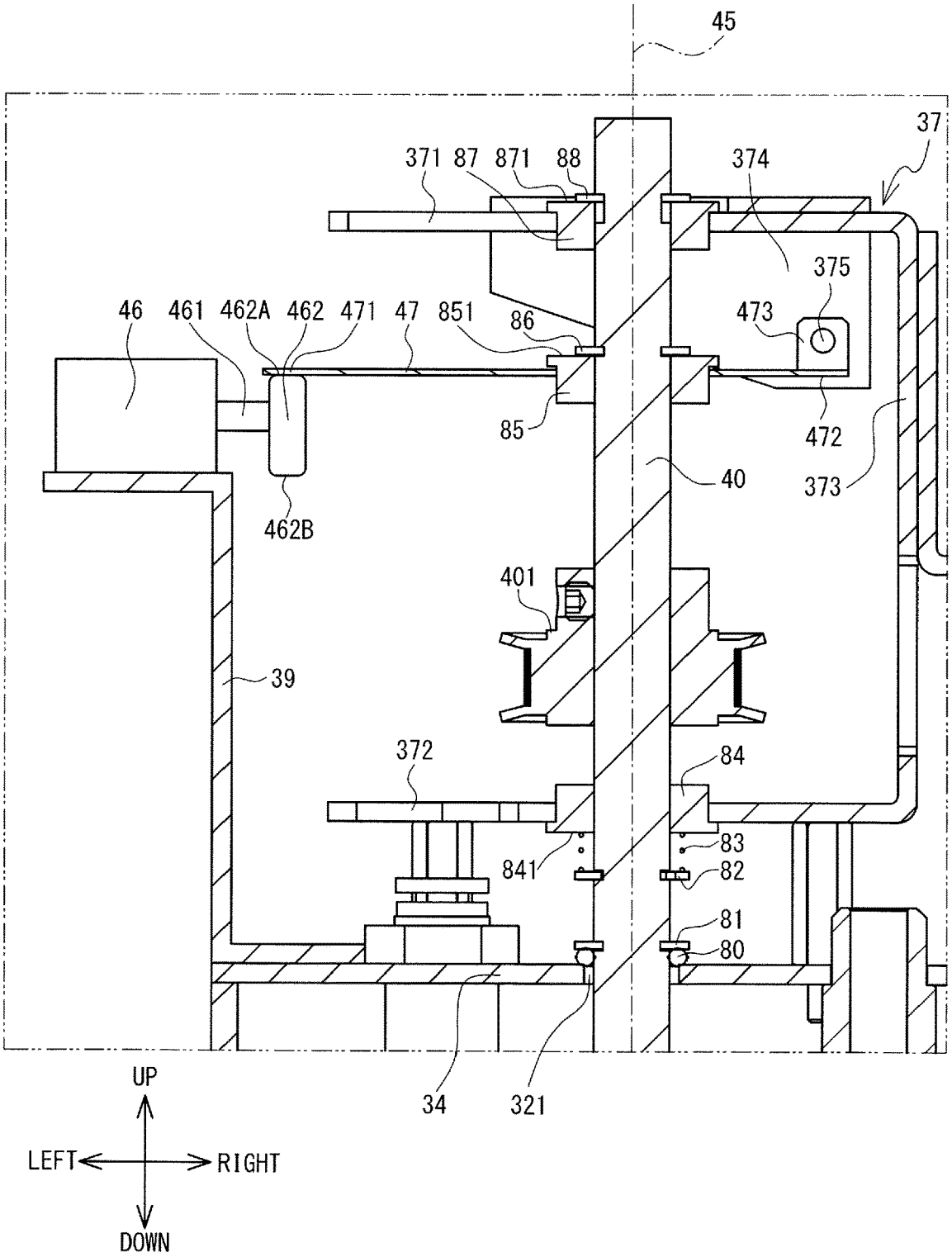
FIG. 4 is an enlarged diagram of a surrounding of a sealing member of a first embodiment.

As shown in FIG. 3, a frame 37 is provided above the lid 34. The frame 37 is provided with an upper wall 371, a lower wall 372, a right wall 373, a rear wall 374 (refer to FIG. 4), and an intermediate wall 47 (refer to FIG. 4). The upper wall 371 and the lower wall 372 extend in the front-rear and the left-right directions. The upper wall 371 and the lower wall 372 extend in parallel to each other while being separated from each other in the up-down direction by a predetermined interval, and are connected to each other by the right wall 373. The right wall 373 extends in the up-down direction. As shown in FIG. 4, the rear wall 374 extends downward from the upper wall 371 and is provided with a shaft portion 375. The shaft portion 375 extends perpendicularly to the rear wall 374. The frame 37 functions as a holding portion that holds the shaft 40 such that the shaft 40 can rotate and can move up and down.

As shown in FIG. 4, the upper wall 371 is provided with a bearing portion 87. The bearing portion 87 is configured from a housing and a bearing (not shown in the drawings) that is held inside the housing. The bearing portion 87 holds the shaft 40 such that the shaft 40 can rotate around the axis line 45 and can move up and down. A locking portion 88 is fixed to the shaft 40 above the bearing portion 87. The locking portion 88 is a disc-shaped member provided with an opening portion in a center of the locking portion 88, for example. The locking portion 88 may be fixed to the outer periphery of the shaft 40 by welding, adhesive, or the like. When the sealing member 80 (to be described later) blocks the space between the shaft 40 and the insertion hole 321, the lower surface of the locking portion 88 comes into contact with an upper surface 871 of the bearing portion 87 and locks the shaft 40, thus preventing the shaft 40 from descending excessively. Further, the lower wall 372 is provided with a bearing portion 84. The bearing portion 84 is configured from a housing and a bearing (not shown in the drawings) that is held inside the housing. The bearing portion 84 holds the shaft 40 such that the shaft 40 can rotate around the axis line 45 and can move up and down.

The intermediate wall 47 is provided between the upper wall 371 and the lower wall 372. The intermediate wall 47 extends in the up-down and left-right directions, and a shaft holding portion 473 is provided on the right end side of the intermediate wall 47. The shaft holding portion 473 is held by the shaft portion 375 such that the shaft holding portion 473 can rotate. A contact portion 471 is provided on the left end portion of the intermediate wall 47. The contact portion 471 is in contact with an eccentric cam 462 to be described later. Further, the intermediate wall 47 is provided with a bearing portion 85. The bearing portion 85 is configured from a housing and a bearing (not shown in the drawings) that is held inside the housing. The bearing portion 85 holds the shaft 40 such that the shaft 40 can rotate around the axis line 45. A locking portion 86 is fixed to the shaft 40 above the bearing portion 85. The locking portion 86 is a disc-shaped member provided with an opening portion in a center of the locking portion 86, for example. The locking portion 86 may be fixed to the outer periphery of the shaft 40 by welding, adhesive, or the like. The lower surface of the locking portion 86 comes into contact with an upper surface 851 of the bearing portion 85 and locks the shaft 40. When the intermediate wall 47 moves upward, the bearing portion 85 moves upward, and raises up the locking portion 86. Thus, the shaft 40 moves upward.

A motor support base 38 is provided on the right wall 373. The motor support base 38 supports the agitator motor 44. A rotating shaft 441 of the agitator motor 44 penetrates the motor support base 38 and protrudes downward. A pulley 442 is fixed to the rotating shaft 441. A pulley 401 is also fixed to the upper portion of the shaft 40. A belt (not shown in the drawings) is stretched between the pulley 401 and the pulley 442. The shaft 40 rotates when the rotating shaft 441 of the agitator motor 44 rotates due to control of a CPU 70 (refer to FIG. 6) to be described later. The agitator blade 41 rotates due to the rotation of the shaft 40. When the agitator blade 41 rotates, the ink 68 that has collected on the bottom portion 303 side of the main tank 30 moves toward the upper portion 300. Thus, the ink 68 is agitated. As a result, a possibility is reduced that components of the ink 68 may precipitate in the main tank 30.

[Sealing Member 80]

As shown in FIG. 4, the sealing member 80 is provided on the outer periphery of the shaft 40, between the lid 34 and the lower wall 372. The sealing member 80 blocks the space between the shaft 40 and the insertion hole 321 for the period during which the agitator blade 41 is not rotating, and opens the space between the shaft 40 and the insertion hole 321 for at least the part of the period during which the agitator blade 41 rotates, for example. The sealing member 80 is an O ring, for example. A locking portion 81 is fixed to the outer periphery of the shaft 40 above the sealing member 80. The locking portion 81 is a disc-shaped member provided with an opening portion in a center of the locking portion 81, for example. The locking portion 81 may be fixed to the outer periphery of the shaft 40 by welding, adhesive, or the like. The lower surface of the locking portion 81 comes into contact with the upper portion of the sealing member 80 and locks the sealing member 80, thus preventing the sealing member 80 sliding to the upper portion of the shaft 40.

[Urging Member 83]

The urging member 83 is provided between the bearing portion 84 and the locking portion 81. The urging member 83 is a coil spring, for example. A support member 82 is fixed to the outer periphery of the shaft 40 below the urging member 83. The support member 82 is a member that supports the lower end portion of the urging member 83, and is, for example, a disc-shaped member provided with an opening portion in a center of the urging member 83. The support member 82 may be fixed to the outer periphery of the shaft 40 by welding, adhesive, or the like. Thus, the upper end portion of the urging member 83 is in contact with a lower surface 841 of the housing of the bearing portion 84, and the lower end portion of the urging member 83 is in contact with the upper surface of the support member 82. The urging member 83 urges the shaft 40 downward. Thus, the sealing member 80 is urged below the side of the insertion hole 321. Note that a lubricant is applied to the lower surface 841 of the housing of the bearing portion 84, thus reducing the frictional resistance between the lower surface 841 and the upper end portion of the urging member 83.

[Configuration of Drive Portion]

A motor support base 39 is provided on the left end portion of the lid 34. The motor support base 39 supports the opening/closing motor 46. The opening/closing motor 46 is a stepping motor, for example. The eccentric cam 462 is fixed to a rotating shaft 461 of the opening/closing motor 46. The contact portion 471 of the intermediate wall 47 is in contact with the eccentric cam 462.

Figure 5:
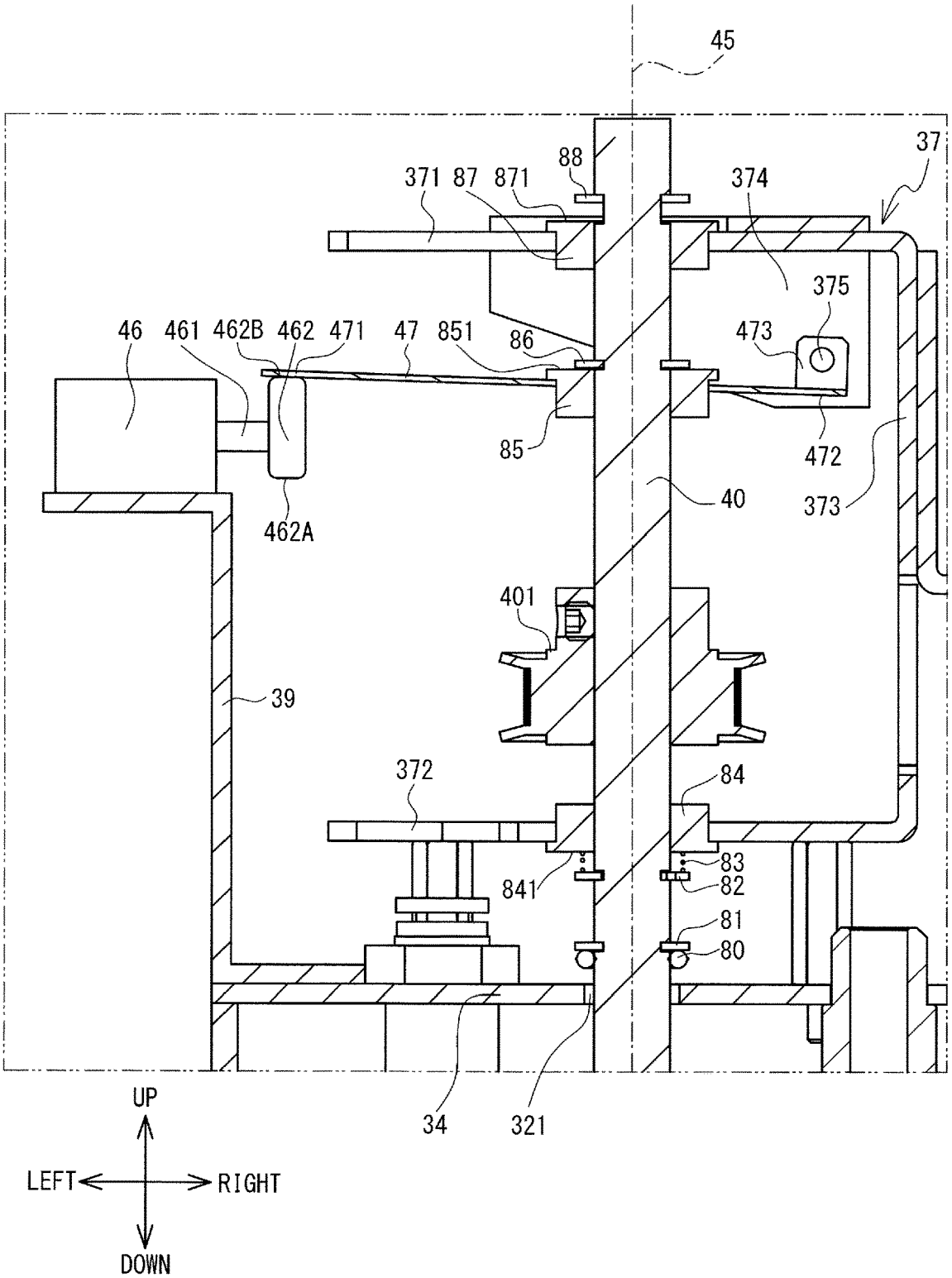
FIG. 5 is an enlarged diagram showing a state in which the sealing member is open.

As shown in FIG. 4, when the rotating shaft 461 of the opening/closing motor 46 rotates a predetermined number of steps, and a section 462A at which a radius from a rotating center to an outer periphery of the eccentric cam 462 is smallest comes into contact with the contact portion 471, the shaft 40 moves downward in the extending direction of the shaft 40 due to the urging force of the urging member 83. Thus, the sealing member 80 moves downward in the extending direction of the shaft 40, and the sealing member 80 blocks the space between the shaft 40 and the insertion hole 321. As shown in FIG. 5, when the rotating shaft 461 of the opening/closing motor 46 rotates a predetermined number of steps, a section 462B at which the radius from the rotating center to an outer periphery of the eccentric cam 462 is largest comes into contact with the contact portion 471. In this case, the contact portion 471 of the intermediate wall 47 is raised up by the eccentric cam 462, and the intermediate wall 47 rotates upward around the rotating shaft 375. The bearing portion 85 is provided on the intermediate wall 47. When the bearing portion 85 moves upward, and the locking portion 86 fixed to the shaft 40 is raised upward, the shaft 40 moves upward. Thus, the sealing member 80 moves upward and opens the space between the shaft 40 and the insertion hole 321.

[Remaining Amount Sensor 42]

The remaining amount sensor 42 is provided on the lower end portion side of the support shaft 43. The remaining amount sensor 42 is provided at a predetermined height inside the main tank 30 at which a remaining amount of the ink 68 is detected. For example, the remaining amount sensor 42 is a float sensor that detects a liquid surface by the up and down movement of a float. The remaining amount sensor 42 outputs, to the CPU 70 (refer to FIG. 6) to be described later, a signal indicating the remaining amount of the ink 68 stored in the main tank 30. The CPU 70 detects the remaining amount of the ink 68 in the main tank 30 on the basis of the signal output by the remaining amount sensor 42.

[Ink Supply Portion 700]

The ink supply portion 700 is a portion that supplies the ink 68 to the head portion 67 and circulates the ink 68. The ink supply portion 700 is provided with the sub pouch 8, the first supply flow path 711, a second supply flow path 712, the first circulation flow path 721, a second circulation flow path 722, a first connection flow path 731, a second connection flow path 732, electromagnetic valves 761, 762, 763, 764, 765, and 766, a filter 771, a pump 751, and a deaeration module 60.

The sub pouch 8 has a bag shape and stores the ink 68 supplied from the main tank 30. The sub pouch 8 supplies the ink 68 to the head portion 67. The head portion 67 ejects the ink 68 supplied from the sub pouch 8 and thus performs printing on a recording medium. A remaining amount sensor 899 is mounted on the sub pouch 8.

The first supply flow path 711, the second supply flow path 712, the first circulation flow path 721, the second circulation flow path 722, the first connection flow path 731, and the second connection flow path 732 are each formed by a hollow tube, for example. The first supply flow path 711 connects to the first tube 53 and to the sub pouch 8, and is a flow path that supplies the ink 68 from the main tank 30 to the sub pouch 8.

The second supply flow path 712 connects to the sub pouch 8 and to the head portion 67, and is a flow path that supplies the ink 68 from the sub pouch 8 to the head portion 67. The first supply flow path 711 and the second supply flow path 712 converge at a first connection portion 791. The first connection flow path 731 is a flow path between the first connection portion 791 and the sub pouch 8. That is, the first connection flow path 731 is a part of the first supply flow path 711 and is also a part of the second supply flow path 712.

The first circulation flow path 721 connects to the second tube 54 and to the sub pouch 8, and is a flow path to circulate the ink 68 from the sub pouch 8 to the main tank 30. The second circulation flow path 722 connects to the head portion 67 and to the sub pouch 8, and is a flow path to circulate the ink 68 from the head portion 67 to the sub pouch 8. The first circulation flow path 721 and the second circulation flow path 722 converge at a second connection portion 792. The second connection flow path 732 is a flow path between the second connection portion 792 and the sub pouch 8. That is, the second connection flow path 732 is a part of the first circulation flow path 721 and is also a part of the second circulation flow path 722.

The electromagnetic valve 761 is provided in the first supply flow path 711. The electromagnetic valve 761 is positioned closer to the sub pouch 8 than a deaeration portion 601 to be described later. The electromagnetic valve 761 is controlled by the CPU 70, and opens and closes the first supply flow path 711. The electromagnetic valve 762 is provided in the first connection flow path 731. The electromagnetic valve 762 is controlled by the CPU 70, and opens and closes the first connection flow path 731. The electromagnetic valve 763 is provided in the second supply flow path 712. The electromagnetic valve 763 is controlled by the CPU 70, and opens and closes the second supply flow path 712.

The electromagnetic valve 764 is provided in the first circulation flow path 721. The electromagnetic valve 764 is controlled by the CPU 70, and opens and closes the first circulation flow path 721. The electromagnetic valve 765 is provided in the second connection flow path 732. The electromagnetic valve 765 is controlled by the CPU 70, and opens and closes the second connection flow path 732. The electromagnetic valve 766 is provided in the second circulation flow path 722. The electromagnetic valve 766 is controlled by the CPU 70, and opens and closes the second circulation flow path 722.

The filter 771 is provided in the first supply flow path 711. The filter 771 removes foreign matter contained in the ink 68 that flows through the first supply flow path 711. The pump 751 is provided in the first supply flow path 711. The pump 751 is provided closer to the sub pouch 8 than the filter 771. The pump 751 sucks up the ink 68 from the main tank 30 and causes the ink 68 to flow to the sub pouch 8 side, which is the downstream side.

The deaeration module 60 is provided in the first supply flow path 711. The deaeration module 60 is provided with the deaeration portion 601, a vacuum filter 602, a pressure reducing pump 603, an electromagnetic valve 604, an air intake filter 605, a pathway 606, a pathway 608, and a pathway 609. The deaeration portion 601 is provided in the first supply flow path 711. The deaeration portion 601 is positioned between the pump 751 and the electromagnetic valve 761. The vacuum filter 602 is connected to the deaeration portion 601 via the pathway 606. The pathway 606 is connected to the pathway 608 at a connection portion 607. The air intake filter 605 is connected to the pathway 608. The electromagnetic valve 604 is provided in the pathway 608. The pressure reducing pump 603 is connected to the vacuum filter 602 via the pathway 609.

The pressure reducing pump 603 operates under the control of the CPU 70, and depressurizes the pathway 606 via the vacuum filter 602. Therefore, air bubbles contained in the ink 68 flowing through the deaeration portion 601 are reduced. When the pathway 606 is depressurized, the electromagnetic valve 604 is controlled by the CPU 70, and closes the pathway 608. When the pathway 606 is not depressurized, the electromagnetic valve 604 is controlled by the CPU 70, and opens the pathway 608. When the pathway 608 is opened, ambient air is supplied to the pathway 606 via the air intake filter 605 and the pathway 606. Thus, the depressurized state of the pathway 606 is released. The air intake filter 605 removes foreign matter from the ambient air flowing to the pathway 608 side.

[Electrical Configuration]

Figure 6:
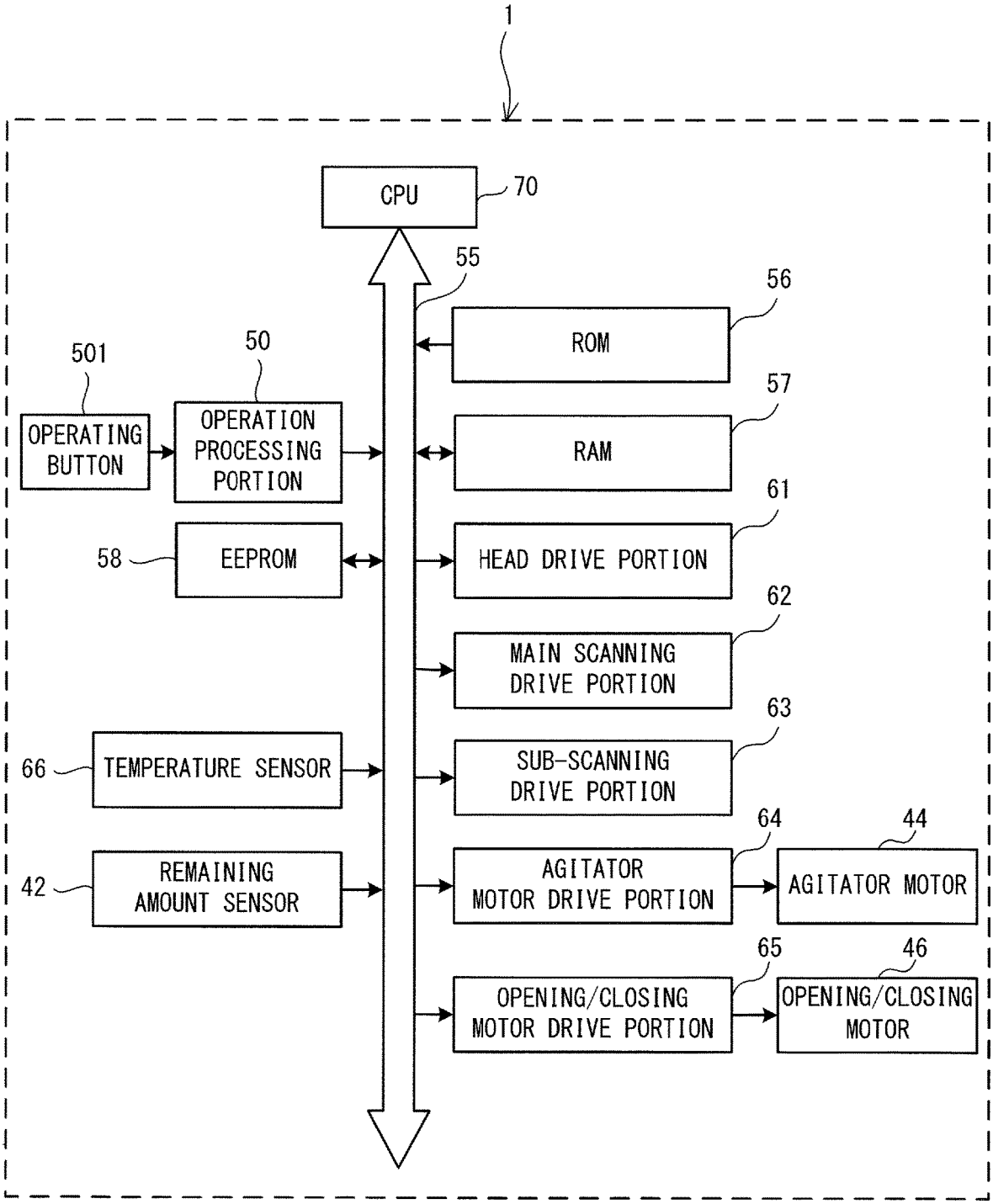
FIG. 6 is a block diagram of an electrical configuration of the print device.

As shown in FIG. 6, the print device 1 is provided with the CPU 70, as a control portion that controls the print device 1. A ROM 56, a RAM 57, an EEPROM 58, a head drive portion 61, a main scanning drive portion 62, a sub-scanning drive portion 63, an agitator motor drive portion 64, an opening/closing motor drive portion 65, the remaining amount sensor 42, a temperature sensor 66, and an operation processing portion 50 are electrically connected to the CPU 70 via a bus 55.

The ROM 56 stores a control program, initial values and the like that are used by the CPU 70 to control operations of the print device 1. The RAM 57 temporarily stores various data that are used in the control program. The EEPROM 58 holds and stores data irrespective of whether a power source of the print device 1 is on or off. The head drive portion 61 is electrically connected to the head portion 67 that ejects the ink 68. The head drive portion 61 selectively drives piezoelectric elements that is provided in each of ejection channels of the head portion 67, and causes the ink 68 to be ejected from the nozzles.

The main scanning drive portion 62 includes the drive motor 19 (refer to FIG. 1) and causes the carriage 20 to move in the left-right direction (the main scanning direction). The sub-scanning drive portion 63 includes a motor and a gear (not shown in the drawings), drives the platen drive mechanism 6 (refer to FIG. 1), and causes the platen 5 (refer to FIG. 1) to move in the front-rear direction (the sub-scanning direction).

The agitator motor drive portion 64 drives the agitator motor 44. The opening/closing motor drive portion 65 drives the opening/closing motor 46. The operation processing portion 50 outputs, to the CPU 70, an operation input on the operating button 501. The temperature sensor 66 detects a temperature inside the main tank 30 and outputs the detected temperature to the CPU 70. The remaining amount sensor 42 detects the remaining amount of the ink 68 and outputs the detected amount to the CPU 70.

[Sealing Member Control]

In the print device 1, the ink 68 having settleability is used, and thus, it is necessary to prevent precipitation of the components of the ink 68. Thus, the CPU 70 agitates the ink 68 inside the main tank 30 using the agitator blade 41, in accordance with predetermined conditions to be described later. The rotation of the agitator blade 41 is performed by the rotation of the shaft 40. Thus, as shown in FIG. 5, when the agitator blade 41 rotates, the CPU 70 opens the space between the shaft 40 and the insertion hole 321. In this way, the sealing member 80 is prevented from coming into contact with edge portions of the insertion hole 321 and being worn away. Further, as shown in FIG. 4, when the agitator blade 41 is not rotating, the CPU 70 blocks the space between the shaft 40 and the insertion hole 321, using the sealing member 80. In this way, the ink 68 is prevented from drying out.

Figure 7:
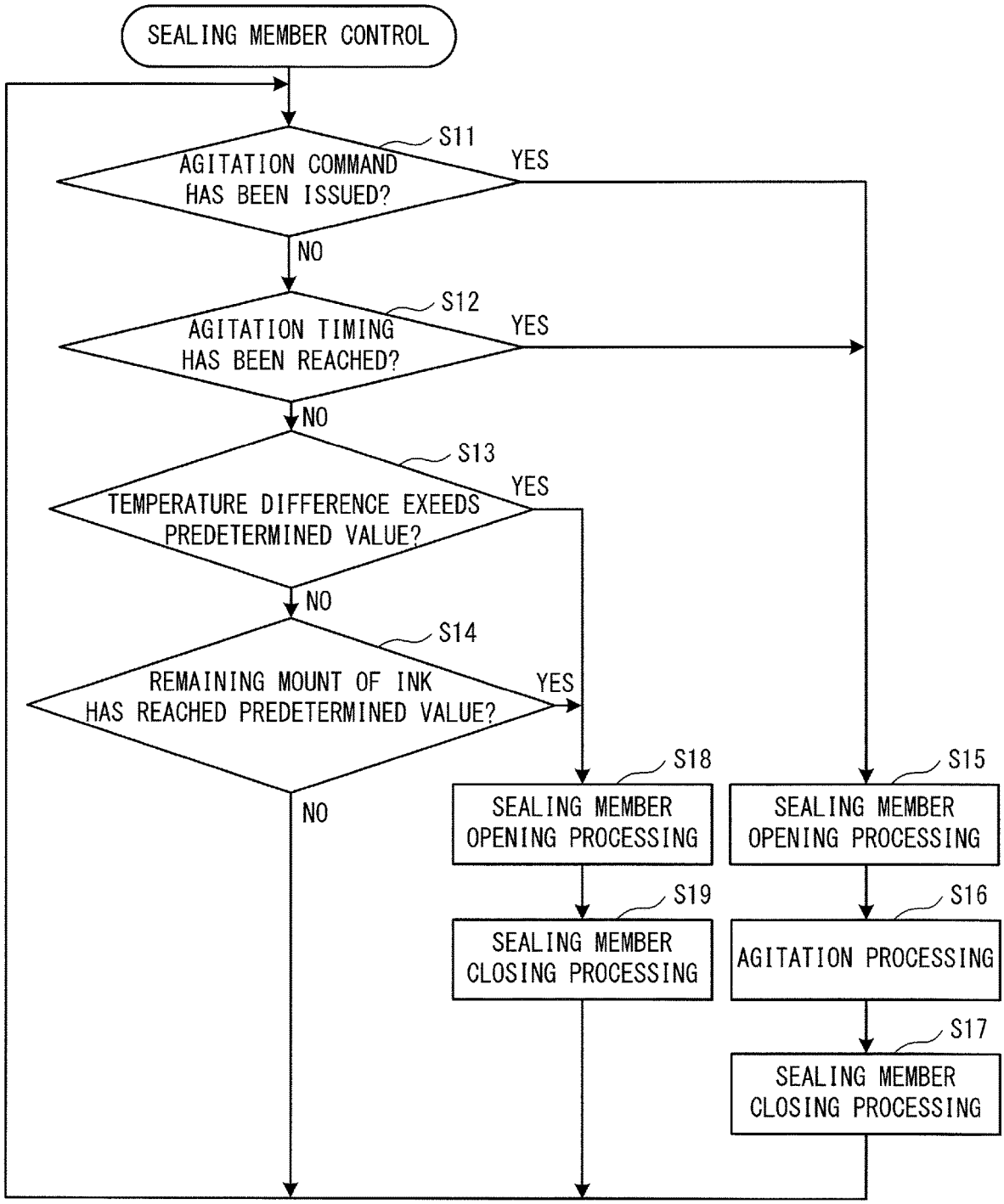
FIG. 7 is a flowchart of sealing member control.

An example of the sealing member control will be explained with reference to FIG. 7. For example, when a power source of the print device 1 is turned on, the sealing member control is performed by operating the print device 1 on the basis of a control program stored in the ROM 56. When the sealing member control is performed, first, the CPU 70 determines whether an agitation command has been issued (step S11). When the operating button 501 is operated and the agitation command is input, the operation processing portion 50 outputs the agitation command to the CPU 70. In this way, the CPU 70 determines that the agitation command has been issued (yes at step S11). Further, when the agitation command is input from a terminal device (not shown in the drawings), such as a personal computer, connected to the print device 1, the CPU 70 determines that the agitation command has been issued (yes at step S11). When it is determined that the agitation command has been issued (yes at step S11), the CPU 70 performs sealing member opening processing (step S15).

In the sealing member opening processing, the CPU 70 drives the opening/closing motor 46 using the opening/closing motor drive portion 65, and rotates the rotating shaft 461 of the opening/closing motor 46 by the predetermined number of steps. In this case, the section 462B at which the radius from the rotating center to the outer periphery of the eccentric cam 462 is largest comes into contact with the contact portion 471 of the intermediate wall 47. Thus, as shown in FIG. 5, the contact portion 471 of the intermediate wall 47 is raised up by the eccentric cam 462, and the intermediate wall 47 rotates upward around the rotating shaft 375. The bearing portion 85 provided on the intermediate wall 47 moves upward, and the locking portion 86 fixed to the shaft 40 is raised upward. In this way, the shaft 40 moves upward. The sealing member 80 thus moves upward. As a result, the space between the shaft 40 and the insertion hole 321 is opened. A first period during which the sealing member 80 opens the space between the shaft 40 and the insertion hole 321 as a result of the sealing member opening processing is one second, for example.

The CPU 70 performs agitation processing (step S16). The CPU 70 drives the agitator motor 44, using the agitator motor drive portion 64, for a predetermined time period. The shaft 40 rotates due to the rotation of the rotating shaft 441 of the agitator motor 44, and the agitator blade 41 rotates. Thus, the ink 68 inside the main tank 30 is agitated. Further, the CPU 70 stores a time and date at which the agitation processing is performed in the EEPROM 58. When the shaft 40 rotates, the sealing member 80 opens the space between the shaft 40 and the insertion hole 321, and thus, the sealing member 80 does not come into contact with the edge portions of the insertion hole 321. Thus, the possibility can be reduced that the sealing member 80 becomes worn and a part of the sealing member 80 enters into the main tank 30.

The CPU 70 performs sealing member closing processing (step S17). In the sealing member closing processing, the CPU 70 drives the opening/closing motor 46 using the opening/closing motor drive portion 65, and rotates the rotating shaft 461 of the opening/closing motor 46 by the predetermined number of steps. In this case, the section 462A at which the radius from the rotating center to the outer periphery of the eccentric cam 462 is smallest comes into contact with the contact portion 471. Thus, the contact portion 471 of the intermediate wall 47 that was raised up by the eccentric cam 462 is urged downward by the urging force of the urging member 83. In this way, as shown in FIG. 4, the shaft 40 moves downward. As a result, the sealing member 80 blocks the space between the shaft 40 and the insertion hole 321. When the sealing member closing processing has been performed, the CPU 70 stores a temperature being detected by the temperature sensor 66 in the EEPROM 58.

The CPU 70 returns the processing to step S11. When it is not determined that the agitation command has been issued (no at step S11), the CPU 70 determines whether an agitation timing has been reached (step S12). For example, when a predetermined period of time has elapsed from the date and time of the previous agitation processing stored in the EEPROM 58, the CPU 70 determines that the agitation timing has been reached (step S12). The predetermined period of time is seven hours, for example. When it is determined that the agitation timing has been reached (yes at step S12), as described above, the CPU 70 performs the sealing member opening processing (step S15), the agitation processing (step S16), and the sealing member closing processing (step S17), and then returns the processing to step S11.

Meanwhile, in the determination processing at step S12, when it is determined that the agitation timing has not been reached (no at step S12), the CPU 70 determines whether a temperature difference exceeds a predetermined value (step S13). For example, the CPU 70 determines whether a temperature difference between the temperature stored in the EEPROM 58 when the previous sealing member closing processing (step S17) was performed and the temperature currently being detected by the temperature sensor 66 exceeds the predetermined value (step S13). The predetermined value is +5° C. or −5° C., for example. Note that the temperature difference may be a temperature difference between a temperature stored in the EEPROM 58 when processing at step S19 to be described later has been performed and the current temperature. When it is determined that the temperature difference exceeds the predetermined value (yes at step S13), the CPU 70 performs sealing member opening processing (step S18). The sealing member opening processing at step S18 is the same as the processing at step S15, and opens the space between the shaft 40 and the insertion hole 321 that was blocked by the sealing member 80. The first period during which the sealing member 80 opens the space between the shaft 40 and the insertion hole 321 as a result of the sealing member opening processing (step S18) is one second, for example. After the first period has elapsed, the CPU 70 performs sealing member closing processing (step S19). The sealing member closing processing at step S19 is the same as the processing at step S17, and the sealing member 80 blocks the space between the shaft 40 and the insertion hole 321. When the sealing member closing processing has been performed, the CPU 70 stores the temperature being detected by the temperature sensor 66 in the EEPROM 58. Next, the CPU 70 returns the processing to step S11.

In the determination processing at step S13, when it is determined that the temperature difference does not exceed the predetermined value (no at step S13), the CPU 70 determines whether the remaining amount of the ink 68 has reached a predetermined value (step S14). For example, when it is determined that the remaining amount of the ink 68 output by the remaining amount sensor 42 has reached the predetermined value (yes at step S14), in the same manner as described above, the CPU 70 performs the sealing member opening processing (step S18). After the first period has elapsed, the CPU 70 performs the sealing member closing processing (step S19). Next, the CPU 70 returns the processing to step S11. Meanwhile, when it is determined that the remaining amount of the ink 68 output by the remaining amount sensor 42 is not the predetermined value (no at step S14), the CPU 70 returns the processing to step S11.

As explained above, in the above-described embodiment, the sealing member 80 blocks the space between the shaft 40 for a period during which the agitator blade 41 is not rotating and the insertion hole 321. As a result, the possibility of the ink 68 drying out can be reduced. Further, the sealing member 80 opens the space between the shaft 40 and the insertion hole 321 for at least a part of period during which the agitator blade 41 is rotating. Thus, when the shaft 40 rotates, the possibility can be reduced that the sealing member 80 comes into contact with the edge portions of the insertion hole 321 and is worn away, and that a part of the sealing member 80 enters into the main tank 30.

The CPU 70 drives the opening/closing motor 46 and rotates the eccentric cam 462, thus moving the shaft 40 up and down in the extending direction of the shaft 40. Thus, when the agitator blade 41 is not rotating, the sealing member 80 provided on the shaft 40 blocks the space between the shaft 40 and the insertion hole 321. As a result, the possibility of the ink 68 drying out can be reduced. Further, when the agitator blade 41 is rotating, the CPU 70 opens the space between the shaft 40 and the insertion hole 321, using the sealing member 80. Thus, the possibility can be reduced that the sealing member 80 comes into contact with the edge portions of the insertion hole 321 and is worn away, and that a part of the sealing member 80 enters into the main tank 30.

In the above-described embodiment, the urging member 83 urges the sealing member 80 toward the insertion hole 321. When the rotating shaft 461 of the opening/closing motor 46 rotates the predetermined number of steps, and the section 462A at which the radius from the rotating center to the outer periphery of the eccentric cam 462 is smallest comes into contact with the contact portion 471, the sealing member 80 moves toward the insertion hole 321 due to the urging force of the urging member 83. As a result, the sealing member 80 blocks the space between the shaft 40 and insertion hole 321. Thus, the possibility can be reduced of the ink 68 stored in the main tank 30 drying out.

In the above-described sealing member control, when YES is determined in the determination processing at step S11 and step S12 when the agitator blade 41 is not rotating, when it is determined that the temperature difference exceeds the predetermined value (yes at step S13), or when it is determined that the remaining amount of the ink 68 has reached the predetermined value (yes at step S14), the CPU 70 performs the sealing member opening processing (step S15 and step S18). Next, after the first period has elapsed, the CPU 70 performs the sealing member closing processing (step S19). As a result, the sealing member 80 opens the space between the shaft 40 and the insertion hole 321 during the first period during which the agitator blade 41 is not rotating. Further, the sealing member 80 blocks the space between the shaft 40 and the insertion hole 321 for a second period during which the agitator blade 41 is not rotating. The second period is different to the first period. Thus, the sealing member 80 can release, over the first period, a pressure inside the main tank 30 that may possibly change over the second period during which the agitator blade 41 is not rotating.

The sealing member 80 opens the space between the shaft 40 and the insertion hole 321 in accordance with the temperature detected by the temperature sensor 66. For example, when it is determined, from the temperature stored in the EEPROM 58 when the previous sealing member closing processing was performed, that a predetermined temperature difference has occurred (yes at step S13), the CPU 70 performs the sealing member opening processing (step S18). If a temperature difference occurs between the temperature currently detected by the temperature sensor 66 and the temperature when the sealing member blocks the space between the shaft 40 and the insertion hole 321 by the temperature sensor 66, pressure occurs inside the main tank 30. When the temperature difference exceeds the predetermined value, the sealing member 80 opens the space between the shaft 40 and the insertion hole 321. As a result, the sealing member 80 can allow the pressure inside the main tank 30 to escape.

The sealing member 80 opens the space between the shaft 40 and the insertion hole 321 in accordance with the remaining amount of the ink 68 detected by the remaining amount sensor 42. Thus, the pressure inside the main tank 30 resulting from changes in the remaining amount of the ink 68 in the main tank 30 can be allowed to escape. Thus, a possibility of pushing out or sucking in the ink 68 inside the head portion 67 due to the changes in the pressure inside the main tank 30 can be reduced.

Second Embodiment

Figure 8:
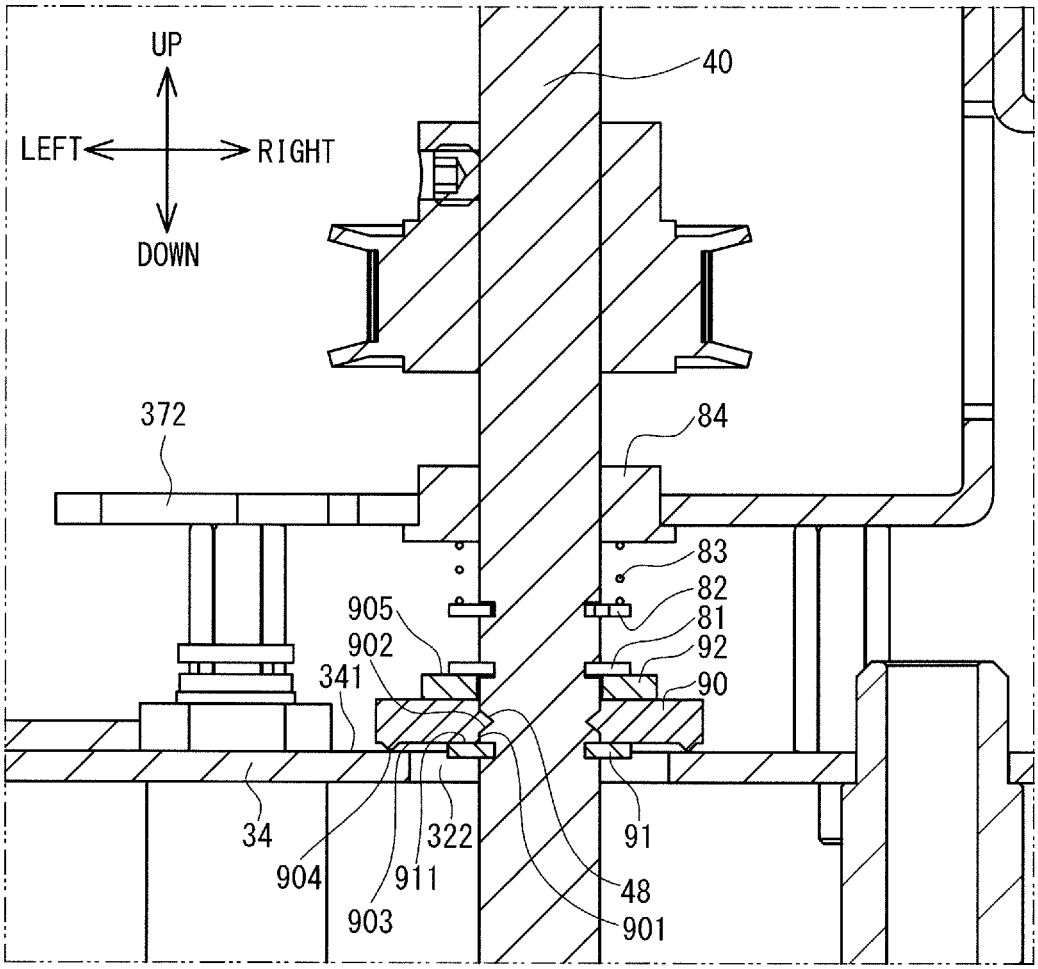
FIG. 8 is an enlarged diagram showing a sealing member of a second embodiment.

As shown in FIG. 8, in a second embodiment, a sealing member 90 is used in place of the sealing member 80 that is the O ring. The sealing member 90 is a disc-shaped member having a predetermined thickness and an opening portion 901. The shaft 40 is inserted through the opening portion 901. The opening portion 901 is provided with a protruding portion 902. The protruding portion 902 fits into a groove portion 48 formed in the shaft 40. It is sufficient that the protruding portion 902 deforms to an extent such that the sealing member 90 can move up and down on a section of the shaft 40 other than the groove portion 48. Alternatively, the sealing member 90 may have a configuration in which a slit is provided in a part of the disc shape, the shaft 40 is inserted through the opening portion 901 in a state in which the slit is widened, and the slit is closed in a state in which the protruding portion 902 is fitted into the groove portion 48. A protruding portion 904 that protrudes downward is formed around a full periphery on an outer peripheral side of a lower surface 903 of the sealing member 90.

A locking portion 91 is fixed to the shaft 40 below the sealing member 90. The locking portion 91 is a disc-shaped member having an opening portion. The locking portion 91 may be fixed to the outer periphery of the shaft 40 by welding, adhesive or the like. An upper surface 911 of the locking portion 91 is in contact with the lower surface 903 of the sealing member 90. Thus, the locking portion 91 locks the sealing member 90 from below. As a result, when the shaft 40 moves upward, the locking portion 91 prevents the sealing member 90 from moving downward not in concert with the movement of the shaft 40. A washer 92 is provided above the sealing member 90, and the locking portion 81 is fixed to the shaft 40 above the washer 92. The locking portion 81 is the disc-shaped member having the opening portion. The locking portion 81 may be fixed to the outer periphery of the shaft 40 by welding, adhesive, or the like. The lower surface of the locking portion 81 is in contact with the upper surface of the washer 92 and locks the washer 92.

The insertion hole 322, through which the shaft 40 is inserted, is formed in the lid 34. An opening diameter of the insertion hole 322 is larger than an opening diameter of the insertion hole 321 shown in FIG. 4 and FIG. 5. The locking portion 91 can enter into the insertion hole 322. As shown in FIG. 8, the shaft 40 extends downward. The locking portion 81 is fixed to the shaft 40. When the shaft 40 moves downward, the locking portion 81 locks the washer 92, and the washer 92 locks the sealing member 90. Thus, the sealing member 90 moves downward as a result of the downward movement of the shaft 40. Thus, the protruding portion 904 of the sealing member 90 is in contact with an upper surface 341 of the lid 34. As a result, the sealing member 90 blocks a space between the shaft 40 and the insertion hole 322.

When the shaft 40 moves upward in the extending direction of the shaft 40, the locking portion 91 is in contact with the sealing member 90, and locks the sealing member 90 from below. As a result, the sealing member 90 moves upward. Thus, the sealing member 90 moves upward together with the shaft 40. Thus, a possibility can be reduced of the locking portion 91 becoming attached to the upper surface 341 of the lid 34 and remaining in the insertion hole 322.

Third Embodiment

Figure 9:
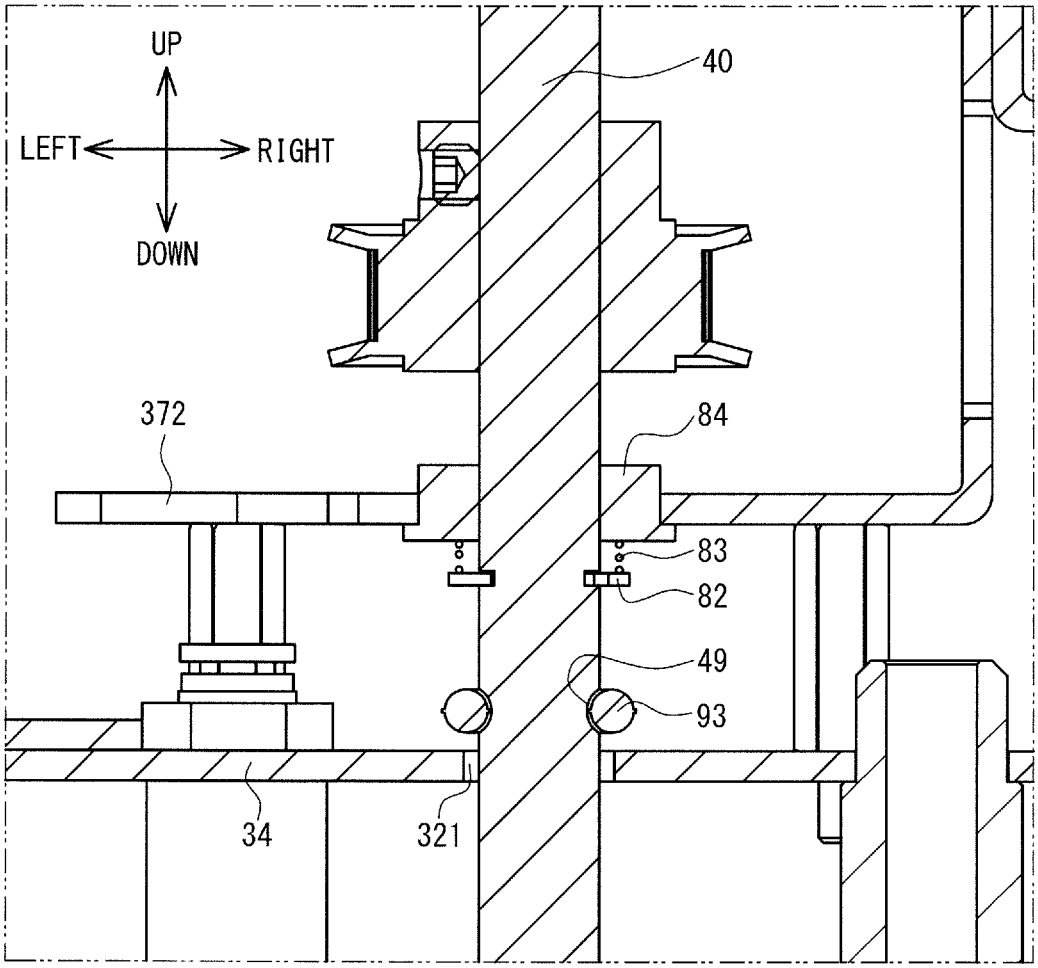
FIG. 9 is an enlarged diagram showing a sealing member of a third embodiment.

As shown in FIG. 9, in a third embodiment, a sealing member 93 is used in place of the sealing member 80. The sealing member 93 is an O ring, and is an O ring that is thicker than the O ring of the sealing member 80 of the first embodiment. A groove portion 49, into which the sealing member 93 fits, is formed in the peripheral direction on the outer peripheral surface of the shaft 40. The sealing member 93 is fitted into the groove portion 49. Thus, as shown in FIG. 9, when the shaft 40 moves downward, the sealing member 93 moves downward together with the shaft 40. As a result, the sealing member 93 blocks the space between the shaft 40 and the insertion hole 321. Further, the sealing member 93 is fitted into the groove portion 49. Thus, when the shaft 40 moves upward, the sealing member 93 moves upward together with the shaft 40. Thus, the locking portion 91 is not necessary. As a result, the possibility can be reduced that the locking portion 91 will remain attached to the insertion hole 321.

Fourth Embodiment

Figure 10:
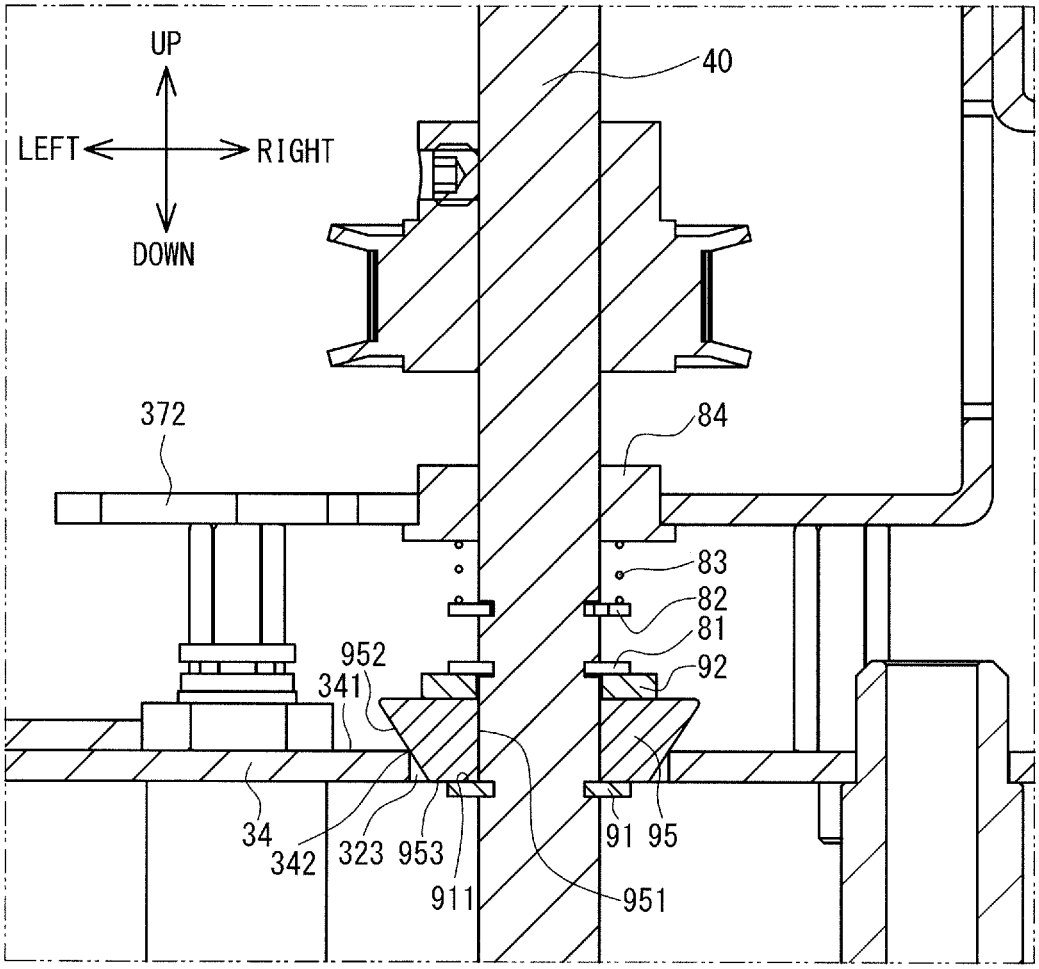
FIG. 10 is an enlarged diagram showing a sealing member of a fourth embodiment.

A fourth embodiment of the present disclosure will be explained with reference to FIG. 10. In the fourth embodiment, a sealing member 95 is used in place of the O ring sealing member 80. The sealing member 95 is a disc-shaped member having a predetermined thickness and an opening portion 951, and a side surface 952 of the sealing member 95 is a conical surface. The shaft 40 is inserted through the opening portion 951.

The locking portion 91 is fixed to the shaft 40 below the sealing member 95. The locking portion 91 is the disc-shaped member having the opening portion. The upper surface 911 of the locking portion 91 is in contact with a lower surface 953 of the sealing member 95. The washer 92 is provided above the sealing member 95, and the locking portion 81 is fixed to the shaft 40 above the washer 92. The locking portion 81 is the disc-shaped member having the opening portion. The lower surface of the locking portion 81 is in contact with the upper surface of the washer 92.

The insertion hole 323, through which the shaft 40 is inserted, is formed in the lid 34. An opening diameter of the insertion hole 323 is larger than the opening diameter of the insertion hole 321 shown in FIG. 4 and FIG. 5. The locking portion 91 can enter into the insertion hole 323. As shown in FIG. 10, when the shaft 40 moves downward, the locking portion 81 presses the washer 92 downward, and the washer 92 presses the sealing member 95 downward. Thus, the side surface 952 of the sealing member 95 is in contact with an end portion 342 of the insertion hole 323 of the lid 34. As a result, the sealing member 95 blocks the space between the shaft 40 and the insertion hole 323.

When the shaft 40 moves upward, the locking portion 91 presses the sealing member 95 upward. Thus, the sealing member 95 moves in concert with the shaft 40. As a result, the possibility can be reduced that the locking portion 91 remains in the insertion hole 323. Further, the side surface 952 of the sealing member 95 is the conical surface. Thus, the side surface 952 can reliably come into contact with the edge of the insertion hole 323, and block the space between the shaft 40 and the insertion hole 323.

The present disclosure is not limited to the embodiment that is described above, and various types of modifications can be made. For example, the main tank 30 may be provided separately from the print device 1, and may be provided in a liquid storage device having an ejection portion that ejects a recording material onto a recording medium using a spray or the like, for example. The present disclosure is particularly effective when the recording material has a high settleability. The recording material is not limited to the ink 68 and may be a discharge agent, a pretreatment agent and the like. The remaining amount sensor 42 is not limited to the float sensor and may be an electrode type sensor, an electrostatic capacitance type sensor, an optical type sensor, a differential pressure type sensor or the like that is capable of detecting a level of a liquid. The remaining amount sensor 42 is not limited to being in the position shown in FIG. 3. The remaining amount sensor 42 may be a weight detection sensor that detects a weight of the ink 68. The remaining amount sensor 42 may be realized by software. For example, in place of the remaining amount sensor 42, the CPU 70 measures a number of times that the ink 68 is ejected and stores the number in the EEPROM 58. The CPU 70 calculates and estimates an ink consumption amount from the number of times that the ink 68 is ejected stored in the EEPROM 58. At step S14 of the sealing member control, the CPU 70 may determine the predetermined value using the estimated ink remaining amount.

Instead of the opening/closing motor 46, a solenoid or the like may be used as the drive portion to move the sealing member 80 up and down. A plunger of the solenoid may be used to move the contact portion 471 of the intermediate wall 47 up and down and move the shaft 40 up and down, thus moving the sealing member 80 up and down. Dynamic lift of the agitator blade 41 may be used to move the shaft 40 up and down and thus move the sealing member 80 up and down. In the first embodiment to the fourth embodiment, the shaft 40 is moved up and down by the opening/closing motor 46 and the eccentric cam 462, and the sealing member 80 is thus moved up and down. In contrast, only the sealing member 80 may be moved up and down using the solenoid, an eccentric cam, and the like. The opening/closing motor 46 is not limited to the stepping motor, and may be a direct current motor or the like that is provided with an encoder.

In the liquid storage device of the first embodiment to the fourth embodiment, the sealing member 80 is provided above the lid 34. The liquid storage device opens the space between the shaft 40 and the insertion hole 321 by moving the sealing member 80 upward, and closes the space between the shaft 40 and the insertion hole 321 by moving the sealing member 80 downward. In contrast to this, the sealing member 80 may be provided below the lid 34. In this case, the space between the shaft 40 and the insertion hole 321 may be opened by moving the sealing member 80 downward, and the space between the shaft 40 and the insertion hole 321 may be closed by moving the sealing member 80 upward. In this case, the urging member 83 is caused to urge the shaft 40 or the sealing member 80 upward. The urging member 83 is not limited to the coil spring. The urging member 83 may be a plate spring or an elastic resin member.

In the determination processing at step S12 of the sealing member control, the predetermined period of time is seven hours, but the predetermined period of time is not limited to seven hours and may be set in accordance with characteristics of the precipitation of the ink 68. In the determination at step S13, the CPU 70 determines YES when the temperature difference has exceeded the predetermined value, but the CPU 70 may determine YES when the temperature difference is equal to or greater than the predetermined value. The CPU 70 may determine YES when the temperature has reached a predetermined value, rather than using the temperature difference. The locking portion 81, the support member 82, and the locking portion 91 may be formed, by shaving or the like, to protrude from the outer peripheral surface of the shaft 40 as an integrated configuration with the shaft 40. The configuration of the deaeration module 60 may be a configuration different to that of the above-described embodiments. The deaeration module 60 need not necessarily be provided. The filter 771 need not necessarily be provided.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid storage device comprising:

a tank configured to store ink to be supplied to an inkjet head;

a shaft configured to be inserted inside the tank via an insertion hole provided in the tank;

an agitator blade disposed inside the tank and connected to the shaft; and a sealing member configured to block a space between the shaft and the insertion hole for a period during which the agitator blade is not rotating and configured to open the space between the shaft and the insertion hole for at least a part of a period during which the agitator blade is rotating.

2. The liquid storage device according to claim 1, further comprising:

a drive portion configured to move the shaft or the sealing member up and down in an extending direction of the shaft.

3. The liquid storage device according to claim 1, further comprising:

an urging member configured to urge the sealing member toward the insertion hole.

4. The liquid storage device according to claim 1, further comprising:

a processor; and a memory storing computer-readable instructions that, when executed by the processor, perform processes including:

opening the space between the shaft and the insertion hole, using the sealing member, for a first period during which the agitator blade is not rotating; and blocking the space between the shaft and the insertion hole, using the sealing member, for a second period during which the agitator blade is not rotating, the second period being different to the first period.

5. The liquid storage device according to claim 4, further comprising:

a temperature sensor configured to detect a temperature, wherein the opening includes opening the space between the shaft and the insertion hole, using the sealing member in accordance with the temperature detected by the temperature sensor.

6. The liquid storage device according to claim 5, wherein the computer-readable instructions, when executed by the processor, further perform a process including:

determining whether a difference between a first temperature and a second temperature exceeds a predetermined value, the first temperature being the temperature currently detected by the temperature sensor, and the second temperature being the temperature detected by the temperature sensor when the sealing member blocks the space between the shaft and the insertion hole, wherein the opening includes opening the space between the shaft and the insertion hole, using the sealing member, in response to determining that the temperature difference exceeds the predetermined value.

7. The liquid storage device according to claim 4, further comprising:

a remaining amount sensor configured to detect a remaining amount of the ink inside the tank, wherein the opening includes opening the space between the shaft and the insertion hole, using the sealing member, in accordance with the remaining amount of the ink detected by the remaining amount sensor.

8. The liquid storage device according to claim 1, further comprising:

a locking portion configured to move the sealing member together with the shaft in the extending direction of the shaft.

9. A liquid storage device comprising:

a tank configured to store a recording material to be ejected onto a recording medium;

a shaft configured to be inserted inside the tank via an insertion hole provided in the tank;

an agitator blade disposed inside the tank and connected to the shaft; and a sealing member configured to block a space between the shaft and the insertion hole for a period during which the agitator blade is not rotating and configured to open the space between the shaft and the insertion hole for at least a part of a period during which the agitator blade is rotating.

* * * * *